US005562069A

United States Patent [19]

Gillbrand et al.

[11] Patent Number: 5,562,069

[45] Date of Patent: Oct. 8, 1996

[54] METHOD AND DEVICE FOR VARYING THE COMPRESSION OF AN INTERNAL COMBUSTION ENGINE

[75] Inventors: Per Gillbrand, Mariefred; Lars Bergsten, Järna, both of Sweden

[73] Assignee: Saab Automobile Aktiebolag, Sweden

[21] Appl. No.: 331,602

[22] PCT Filed: May 7, 1993

[86] PCT No.: PCT/SE93/00399

§ 371 Date: Nov. 3, 1994

§ 102(e) Date: Nov. 3, 1994

[87] PCT Pub. No.: WO93/23664

PCT Pub. Date: Nov. 25, 1993

[30] Foreign Application Priority Data

May 11, 1992 [SE] Sweden ..... 9201472

[51] Int. Cl.[6] ..... F02D 15/04

[52] U.S. Cl. ..... 123/48 C; 123/78 C

[58] Field of Search ..... 123/78 C, 48 R, 123/78 R, 48 B, 48 C

[56] References Cited

U.S. PATENT DOCUMENTS

| | | | |
|---|---|---|---|
| 2,433,639 | 12/1947 | Woodruff et al. | 123/48 B |
| 2,770,224 | 11/1956 | Ericson | 123/48 C |
| 3,633,552 | 1/1972 | Huber | 123/48 R |
| 4,174,683 | 11/1979 | Vivian | 123/78 C |
| 5,025,757 | 6/1991 | Larsen | 123/78 R |
| 5,113,809 | 5/1992 | Ellenburg | 123/78 R |
| 5,331,928 | 7/1994 | Wood | 123/78 B |

FOREIGN PATENT DOCUMENTS

| | | | |
|---|---|---|---|
| 2404231 | 7/1975 | Germany | 123/78 C |
| 3542629 | 2/1989 | Germany . | |
| 6-137176 | 5/1994 | Japan | 123/78 C |

*Primary Examiner*—David A. Okonsky
*Attorney, Agent, or Firm*—Ostrolenk, Faber, Gerb & Soffen, LLP

[57] ABSTRACT

Method and adjusting device for varying the compression of an internal combustion engine with a cylinder receiving section (2) which is pivotably mounted in the crankcase section (4) of the engine supporting the crankshaft, about a tilting shaft bearing (8) on one side of the engine, to effect a variation in the engine compression. A tilting mechanism (70) acting between the crankcase section and the cylinder receiving section is arranged on the side of the engine opposite the tilting shaft bearing (8), enabling the distance between the two engine parts to be varied. A hydraulic adjusting device (76, 78) is connected to the tilting mechanism (70) for adjusting the lateral tilting of the cylinder receiving section (2) relative to the crankcase section (4). The adjusting device operates mainly without the supply of external driving force and uses hydraulic pressure energy stored in a pressure accumulator (96) which is charged with pressure energy derived from the compression and combustion in the engine cylinders and is transmitted to the accumulator (96) via the tilting mechanism (70) and the adjusting device (76, 78). The tilting mechanism comprises a mechanism which is rotatably mounted in the crankcase section (4) and whose variation in angular position corresponds to the variation in the distance between the cylinder receiving section and the crankcase section. The angular movement of the mechanism (56, 72) is used for varying the effective length of a hydraulic piston-cylinder arrangement (78) connected between the crankcase section (4) and the cylinder receiving section (2), the moving piston (82) of which arrangement divides the interior of the cylinder housing (80) into two variable chambers (92, 94), one (94) of which can be hydraulically connected to a reservoir (108) and the other (92) to the pressure accumulator (96).

12 Claims, 4 Drawing Sheets

METHOD AND DEVICE FOR VARYING THE COMPRESSION OF AN INTERNAL COMBUSTION ENGINE

CROSS REFERENCE TO RELATED APPLICATIONS

This application is related to U.S. Ser. No. 08/070,354 filed Jun. 3, 1993 in the name of Per Ing Nilsson, et al. and entitled "INTERNAL COMBUSTION ENGINE WITH VARIABLE COMPRESSION PROVIDED WITH REINFORCEMENTS OF THE CRANKCASE SECTION IN THE REGION OF THE MAIN BEARINGS", the entire disclosure of which is incorporated by reference herein.

This invention relates to a method and apparatus for varying the compression of an internal combustion engine of the type having a cylinder receiving section pivotably mounted to a crankcase section.

An internal combustion engine, for example an in-line engine, of the type in question, has a cylinder receiving section (a cylinder block) which is pivotably connected to the crankshaft supporting crankcase section of the engine by a tilting shaft bearing arrangement connecting the parts on one side of the engine. The cylinder receiving section supports a cylinder head which forms the cylinder head of the engine. In the case of an engine with overhead camshafts, these are mounted in the cylinder head. On the side of the engine opposite the tilting shaft bearing arrangement there is a tilting mechanism arranged between the cylinder receiving section and the crankcase section, with which mechanism the cylinder receiving section and the cylinder head connected to it can be inclined laterally relative to the crankcase section by pivoting about the tilting shaft bearing arrangement.

Because the cylinder receiving section can be inclined (tilted) laterally relative to the crankcase section, the distance between the crankshaft (with adhering pistons) and the cylinders will be variable. The volume of that part of the combustion chamber which is located above the upper limiting surface of the respective pistons, in the upper turning position of the piston (upper dead centre) can therefore be increased by lateral inclination of the cylinder receiving section relative to the crankcase section. This means that the compression ratio of the engine will be variable, enabling the efficiency of the engine to be optimised for varying driving loads, which results in improved engine performance.

The tilting shaft bearing arrangement between the crankcase section and the cylinder receiving section is, as already mentioned, arranged on one side of the engine, whilst the mechanism with which the cylinder receiving section can be inclined relative to the crankcase section is arranged on the opposite side of the engine. The tilting shaft bearing arrangement suitably incorporates a lateral inclination shaft which runs parallel with the crankshaft and which is housed in axially separated bearing brackets which are rigidly connected to this crankcase section and are positioned in line with each other along the outside of the cylinder receiving section, preferably in its lower region. In the intervals between the bearing brackets are situated bearing lugs in the cylinder receiving section mounted on the sections of the lateral inclination shaft located there. The tilting shaft bearing arrangement therefore consists of the bearing brackets, the lateral inclination shaft and the bearing lugs, which together form a type of longitudinal hinge mechanism between the crankcase section and the cylinder receiving section.

The tilting mechanism on the opposite side of the engine may, for example, incorporate essentially vertically directed rods resembling connecting rods, whose upper ends are swivelled on an upper bearing shaft parallel to the crankshaft and passing along the cylinder receiving section. The lower ends of the rods may then be eccentrically mounted on an eccentric shaft, which is in turn swivelled in bearing brackets rigidly connected to the crankcase section. The upper bearing shaft is in this case supported in the upper region of the cylinder receiving section by means of bearing brackets which are rigidly connected to the cylinder receiving section. The distance between the upper bearing shaft and the bearing brackets housing the eccentric shaft in the crankcase section may therefore be varied by rotating the eccentric shaft. By varying this distance this side of the cylinder receiving section can be raised or lowered relative to the crankcase section, which gives rise to a lateral inclination/tilting of the cylinder receiving section relative to the crankcase section.

The bearing brackets connected to the crankcase section for the lateral inclination shaft on one side of the engine, and the bearing brackets similarly connected to the crankcase section for the eccentric shaft, on the other side of the engine, are suitably positioned in pairs in transverse vertical planes between the cylinders perpendicular to the crankcase.

As an example of prior art in this field it can be mentioned that U.S. Pat. No. 2,770,224 describes a four-cylinder overhead valve engine in which a cylinder receiving section, with associated cylinder head/cover is pivotably hinged to a stationary crankcase section. The cylinder receiving section of the engine can i this case be inclined laterally relative to the crankcase section about a longitudinal guide shaft (lateral tilting shaft) on one longitudinal side of the engine. The mechanism which provides the inclination (the lateral tilting) of the cylinder receiving section relative to the crankcase section incorporates, in this overhead valve engine, a servomotor in the form of a vacuum tank which effects the lateral inclination of the cylinder receiving section by means of a lever and shaft mechanism fitted with a crank journal. The vacuum which is used here is the vacuum generated by the negative pressure in the engine intake manifold. This means that an unreasonably large, bulky vacuum tank must be used, in addition to which the response of this servomotor will be inadequate because it is impossible to obtain a greater regulating force than is possible with the negative pressure generated in the intake manifold.

With this known design a tilting control device must be used which is dependent on external adjusting forces for effecting the tilting movement, and these adjusting forces are also wholly dependent on and limited by the negative pressure available in the intake manifold.

SUMMARY OF THE INVENTION

A principal object of this invention is to avoid the above-mentioned disadvantages inherent in the known tilting mechanism, and instead provide a method and device with which the lateral inclination of the cylinder receiving section (and hence the engine compression) can be adjusted mainly without requiring external forces or fluid pressure, and without such forces and pressure having to be supplied to bring about the lateral inclination.

The above-mentioned object is achieved according to the invention by a method of varying the compression which comprises providing tilting means for tilting the cylinder receiving section relative to the crankcase section to adjust the distance between the cylinder receiving section and the crankcase section. The tilting means includes an adjusting mechanism comprising a hydraulic piston-cylinder arrangement wherein the piston divides the cylinder into two variable chambers. The position of the piston in the cylinder is adjusted to adjust the distance between the cylinder section and the crankcase section to thereby vary the compression of the engine.

A compression control device in accordance with the invention comprises tilting means for moving the crankcase section relative to the cylinder receiving section. The tilting means includes an adjusting mechanism in the form of a hydraulic piston-cylinder arrangement connected between the crankcase section and the cylinder receiving section. The hydraulic piston-cylinder arrangement includes a piston moveable within the cylinder which divides the cylinder into first and second chambers. One hand in that the process (of the type indicated in the preamble) involves taking the measures indicated in the characterizing section of claim 1, and on the other in that the compression control device (of the type indicated in the preamble) exhibits the distinctive features indicated in the characterizing section of claim 7.

Suitable further developments of the process are indicated in dependent claims 2–6, and practical embodiments of the compression control device are indicated in claims 8–10.

The basic concept of the invention may be said to be that kinetic energy, which is obtained when the cylinder receiving engine section and the crankcase section are tilted apart (i.e. during a reduction in compression), is stored for later use in the form of hydraulic pressure in a pressure accumulator.

The hydraulic pressure energy thus stored can then be used in a subsequent tilting back of the cylinder receiving section in the direction of the crankcase section (i.e. for increasing the engine compression).

The energy which is stored and accumulated is generated internally in the engine as a result of the compression and combustion which take place in the engine cylinders. This stored energy is transferred from the cylinder receiving section in the form of movements of the tilting mechanism and the hydraulic piston-cylinder arrangement connected to it.

BRIEF DESCRIPTION OF THE DRAWINGS

The invention will now be described and explained in more detail with reference to the embodiments illustrated in the attached drawings.

In the figures in the drawings.

DESCRIPTION OF THE PREFERRED EMBODIMENTS

The invention is described below with reference to a four-cylinder in-line engine of the Otto type, which can be used for driving a passenger car, for example.

The engine, which has overhead camshafts, is designed so that its compression ratio can be varied. This is achieved in that the cylinder receiving section 2 of the engine is mounted so that it can be laterally inclined on crankcase section 4 of the engine, in which section is mounted crankcase 6. The lateral tilting or inclination of cylinder receiving section 2 takes place about a tilting shaft bearing 8 on one side of the engine (the left-hand side in the design shown).

Figure 1A:
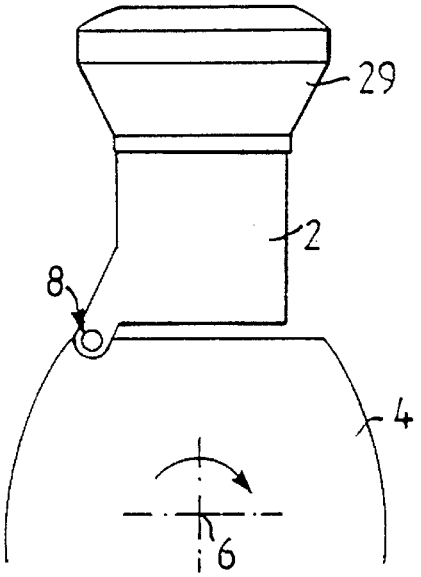
FIG. 1A, FIG. 1B, FIG. 2 and FIG. 3 show diagrammatic end views of internal combustion engines with variable compression provided by lateral tilting or inclination of the cylinder receiving section relative to the crankcase section.
Figure 1B:
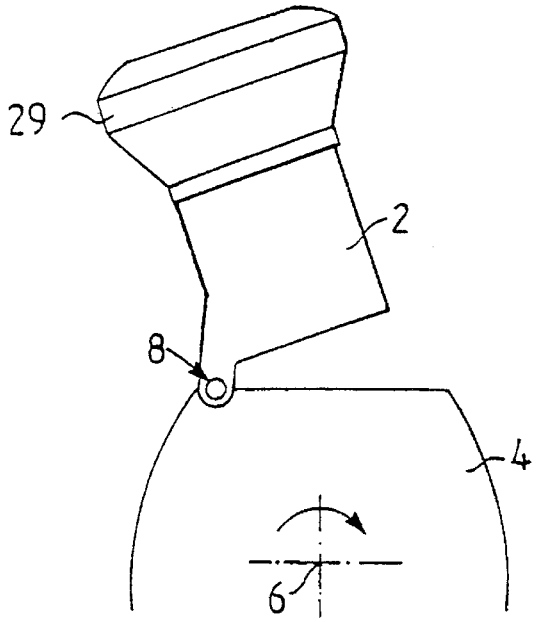
Figure 2:
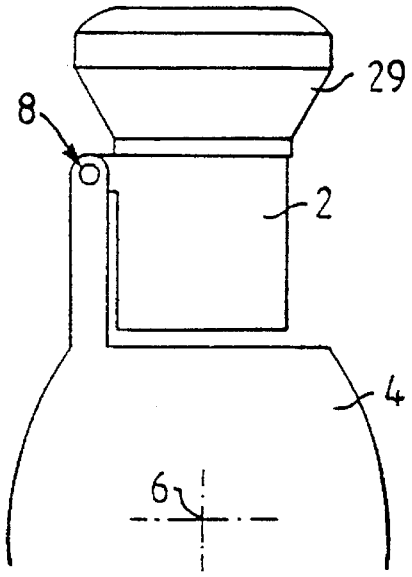
Figure 3:
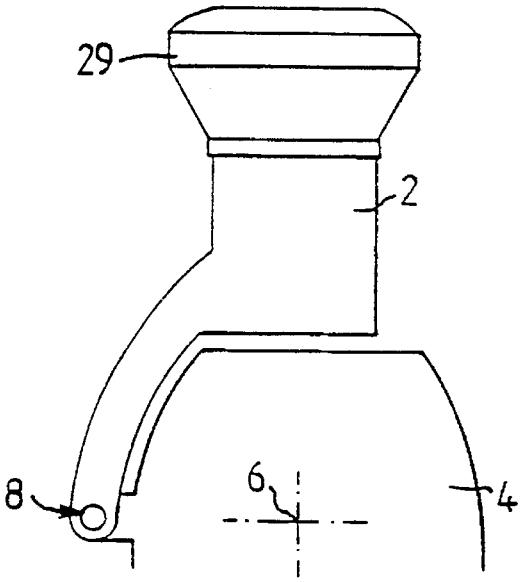

FIGS. 1A–1B show alternative positions of tilting shaft bearing 8 between the cylinder receiving section and the crankcase section. FIGS. 1A–1B therefore show the tilting shaft bearing positioned on the lower edge of the cylinder receiving section, whilst FIG. 2 shows the tilting shaft bearing positioned on the upper edge of the cylinder receiving section, and FIG. 3 shows the tilting shaft bearing positioned on the side of the lower part of the crankcase section, level with crankshaft 6. For the design types according to FIGS. 1A, 1B, 2 and 3 it is generally the case that cylinder receiving section 2 may either be integrated with associated cylinder head 29, or may be removably connected to the cylinder head by detachable bolted or screwed joints.

In the following reference is made mainly to FIGS. 4–6, which show an embodiment in which tilting shaft bearing 8 is positioned as shown in FIGS. 1A–1B.

The in-line engine has a cylinder receiving section 2 (with four cylinders 10, see FIG. 6), and a crankcase section 4, in which crankshaft 6 is mounted. In FIG. 4 a crank journal of crankshaft 6 is denoted by 12. In each cylinder 10 there is a moving piston 14, which is connected to an associated crank journal section 12 of crankshaft 6 by a connecting rod 16. On the bottom of crankcase section 4 there is also an oil sump, but this is not shown in the figures.

Figure 4:
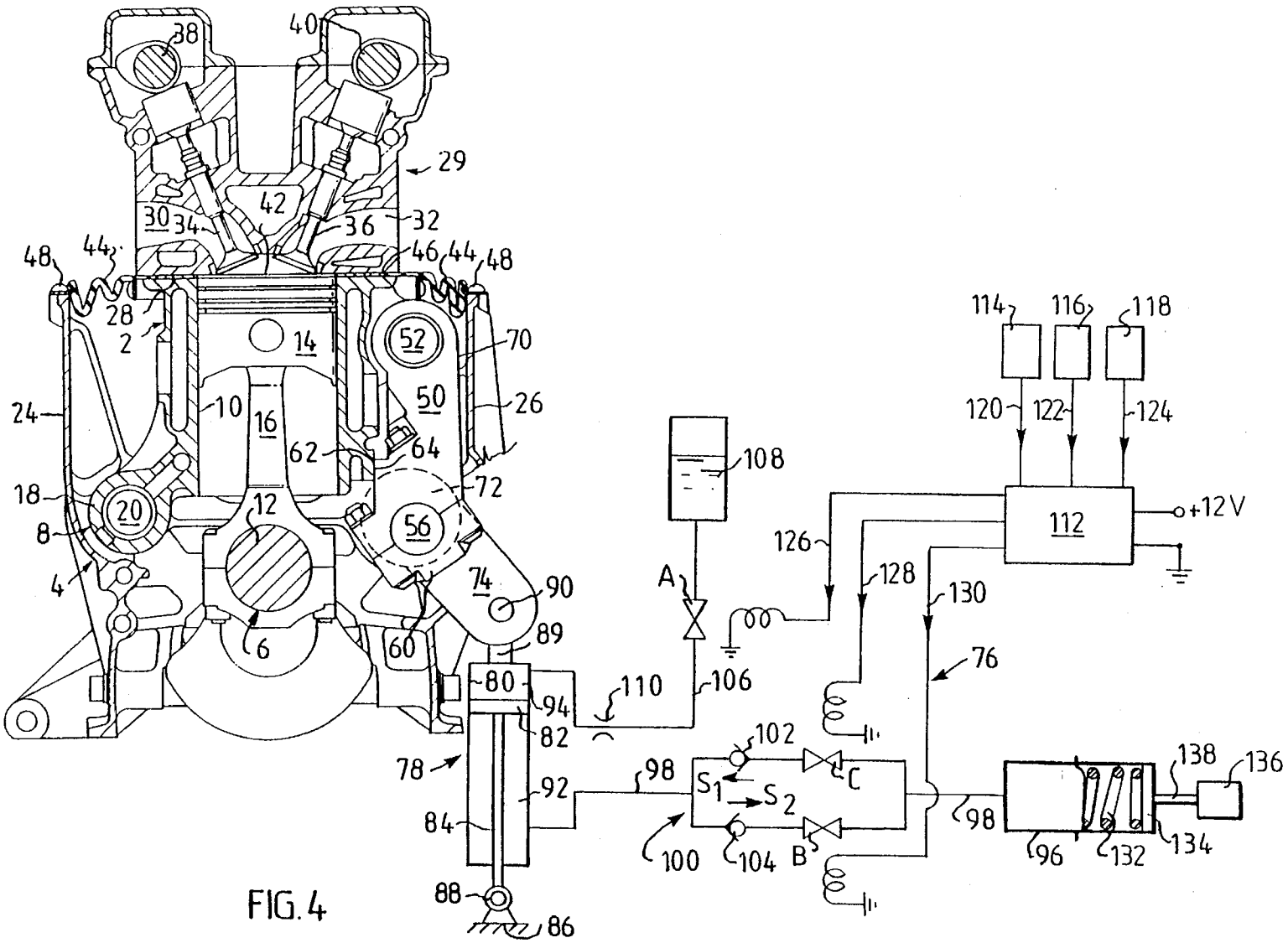
FIG. 4 shows a vertical section through an engine of the type shown in FIG. 1A–1B (in a position for maximum compression), where the hydraulic piston-cylinder arrangement connected to the tilting mechanism, with associated hydraulic circuit, is only shown diagrammatically.
Figure 5:
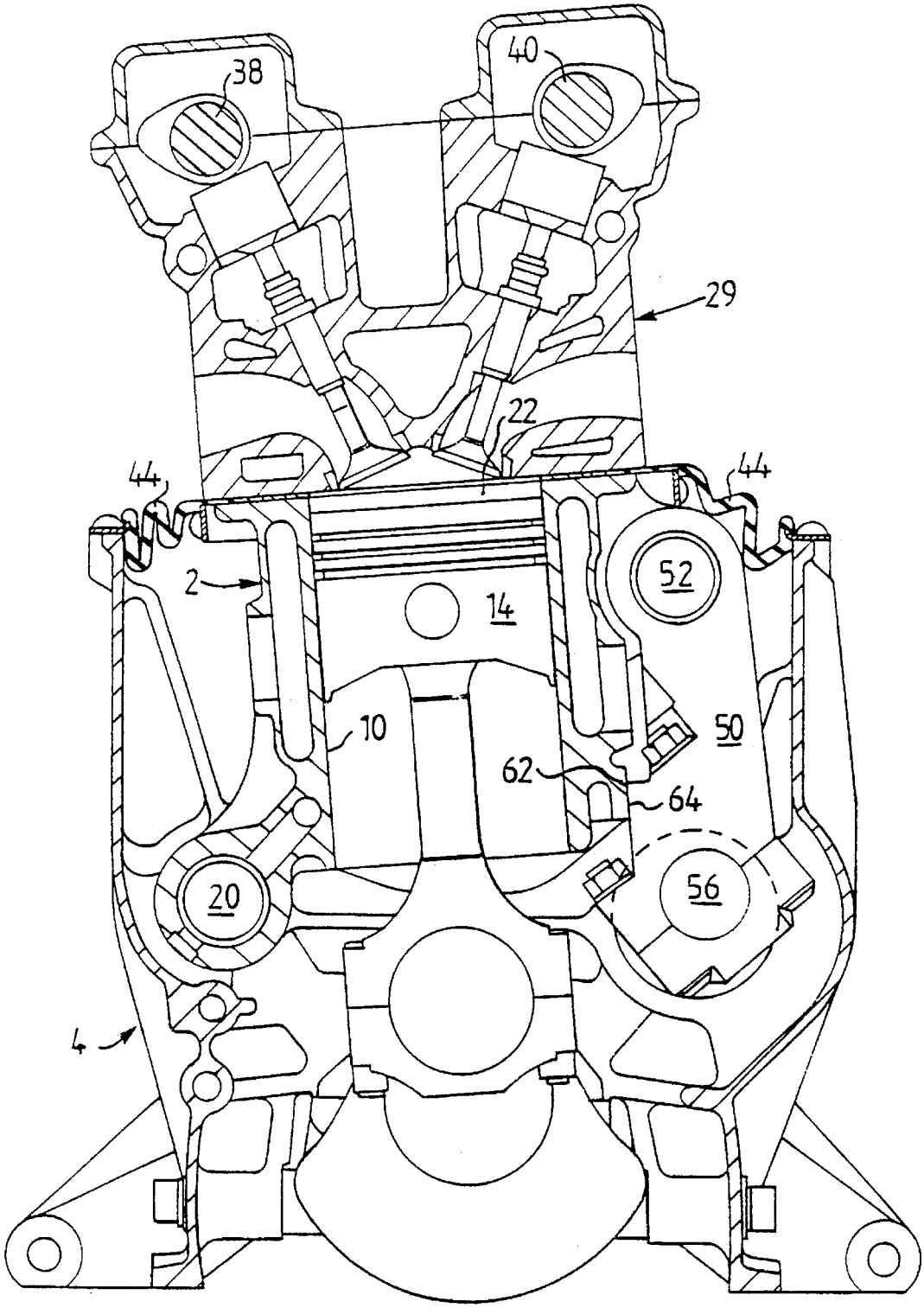
FIG. 5 shows the engine according to FIG. 4 in a position with maximum lateral inclination of the cylinder receiving section, for minimum compression.
Figure 6:
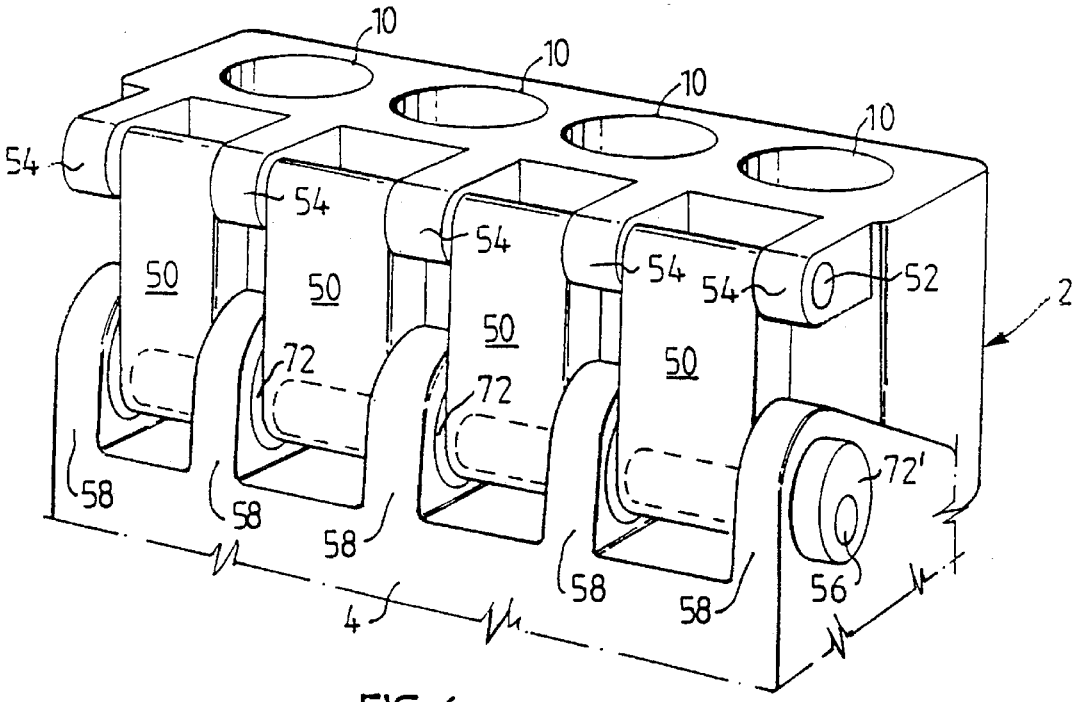
FIG. 6 shows diagrammatically, in perspective, the essential parts of the tilting mechanism for raising/lowering the right-hand side of the cylinder receiving section of the engine in a design of the type shown in FIGS. 4–5.

At the bottom, on the left-hand side in FIG. 4, cylinder receiving section 2 has four bearing lugs 18 (only one is shown in FIGS. 4, 5), through which is passed a tilting or lateral inclination shaft 20, mounted in five bearing brackets connected to crankcase section 4, the middle three of which are located between bearing lugs 18, and the two outermost receiving the ends of shaft 20. Tilting shaft bearing 8 allows tilting (inclination) of cylinder receiving section 2 relative to crankcase section 4, about shaft 20. Because crankshaft 6 is mounted in crankcase section 4, and pistons 14 are connected to the crankshaft, whilst section 2 can be swivelled away from the crankshaft by lateral inclination, cylinders 10 can be displaced a short distance obliquely upwards/outwards relative to pistons 14. This relative movement between each piston and the associated cylinders gives rise to a certain lowering or pulling down of the piston in the cylinder, which causes excess volume 22 in the combustion chamber above piston 14 (see FIG. 5) when the piston is in the upper dead centre position. This results in a reduced compression ratio compared to that applicable to engine parts 2, 4 in the position shown in FIG. 4.

Crankcase section 4 has raised lateral walls 24, 26 which extend approximately to the level of the upper limiting surface 28 of section 2. At the front and rear end of the engine there is also a gear case and end plate (not shown) which form the front and mar end wall of crankcase section 4 respectively, and which connect lateral walls 24, 26 together. The gear case and end plate also terminate at essentially the same level as that on which surface 28 is located. Cylinder receiving section 2 is therefore surrounded by walls on all sides. Lateral walls 24, 26 need not necessarily be integral with crankcase section 4, but may instead constitute separate wall sections mounted on crankcase section 4.

A cylinder head 29, with inlet and outlet ducts 30, 32, inlet and outlet valves 34, 36, and overhead camshafts 38, 40, is secured to surface 28 of cylinder receiving section 2. Normal arrangements (not shown), such as inlet and outlet systems and apparatus for fuel injection, supercharging and exhaust cleaning, are also connected to the inlet and outlet ducts.

Between cylinder head 29 and cylinder receiving section 2 there is a cylinder head gasket 42, and between section 2 and lateral walls 24, 26, and the gear case and end plate, is arranged an elastic seal 44, which extends around the entire periphery of section 2 and serves to seal the engine crankcase, The seal is designed so that it can move, be bent upwards and downwards, and assume different vertical positions in different areas. Inner edge 46 of the seal is tightly clamped between cylinder head 29 and cylinder receiving section 2. A plate edge is cast in at the outer edge of seal 44 and is secured by means of joints 48 so that it seals against the upper limiting surfaces of walls 24, 26, the gear case and end plate.

On the side of the engine opposite tilting shaft 20 is arranged a tilting mechanism 70, which acts between crankcase section 4 and cylinder receiving section 2, and serves to bring about the variation in the distance between engine sections 2 and 4 causing the variation in compression. Tilting mechanism 70 composes four rods 50 resembling connecting rods (see FIG. 6), the upper ends of which are pivotably mounted on a longitudinal shaft 52 housed in five bearing brackets 54 connected to cylinder receiving section 2. At its lower ends rods 50 are pivotably mounted on an eccentric shaft 56 which is in turn rotatably mounted in five bearing brackets 58 rigidly mounted on the crankcase section. At the lower ends rods 50 have bearing caps 60 for simple assembly/removal of the rod enclose on shaft 56.

As shown in FIG. 4 tilting mechanism 70 is connected by a laterally projecting lever 74 connected to a hydraulic control device 76 for controlling the lateral tilting of cylinder receiving section 2 relative to crankcase section 4 effected by rotation around the tilting axle beading 8.

Lever 74 can be rigidly mounted on, or rigidly connected to one of the enlarged bearing sections 72 (see FIG. 6), with which the eccentrically positioned shaft 56 is mounted in bearing brackets 58. Lever 74 can also be secured, for example, to beading section 72' axially projecting from bearing bracket 58 located at the end of crankcase section 4.

As shown, hydraulic control device 76 incorporates a piston-cylinder arrangement 78 articulated to lever 74 and consisting of a cylinder housing 80 with a piston 82 which moves backwards and forwards inside it and whose piston rod 84, projecting from the cylinder housing, is anchored at its outer end to a frame section 86 via a hinge 88. Frame section 86 may form part of crankcase section 4 or may be rigidly connected to the same by other means. Cylinder housing 80 is pivotably connected by a shaft-like extension 89 to lever 74 via a hinge 90. Piston 82 divides the interior of cylinder housing 80 into a first chamber 92 and a second chamber 94.

Chamber 92 is connected hydraulically to a pressure accumulator 96 via a pipe 98, which incorporates a non-return valve arrangement 100, which is provided with two alterative flow paths with opposing directions of flow, namely an upper branch path for flow in direction $S_1$, and a lower branch path for flow in direction $S_2$. The upper flow path contains a non-return valve 102 opening in direction $S_1$, and a shutoff valve C which can be controlled by means of an electromagnet, whilst the lower flow path contains a non-return valve 104 opening in direction $S_2$ and a shutoff valve B which can be controlled by means of an electromagnet.

Chamber 94 is connected by hydraulic pipe 106 to a hydraulic fluid reservoir 108. The flow through pipe 106 is regulated by means of a shutoff valve A, which is controlled by means of an electromagnet. Pipe 106 also incorporates a throttle 110.

Pressure accumulator 96 is shown in FIG. 4 and is provided with a pressure balancing, adjustable preloading spring 132, whose active resilience is adjustable in that the upper end of the spring is supported against a retaining plate 134 whose axial position in accumulator 96 is adjustable by means of an adjuster 136, which is capable of displacing plate 134 by means of its pushrod 138 mounted in plate 134, thereby altering the active force of spring 132.

Spring 132 is designed so that it can be adjusted largely to balance the forces in the hydraulic system. Thus only a little additional force is required for the adjustment in other words the resilience in the hydraulic system (i.e. the force from spnng 132 in accumulator 96) can be used to balance the forces. Consequently a relatively weak adjusting device is capable of performing the work required for the engine adjustment.

Instead of the design with adjustable spring 132 in accumulator 96, an alternative design is conceivable with a small hydraulic pump, which can be used for pressuring the hydraulic adjusting system in selected sections.

Before we proceed to describe how hydraulic adjusting device 76 connected to tilting mechanism 70 operates, we shall briefly remind the reader of the object and means of the invention.

The task of the process and compression adjustment device to which the invention relates is to provide controlled lateral tilting of cylinder receiving section 2 relative to crankcase section 4 of the engine. The idea behind this is to use the internal separating forces between the cylinder receiving section and the crankcase section generated in the engine due to the compression and combustion in the cylinders, and to store these separating forces in a pressure accumulator for later use when the cylinder receiving section contracts in the direction of the crankcase section to provide increased compression in the engine. In engine load cases where rapid adjustment of the compression is desirable, i.e. mainly when the compression is required to be reduced, the separating forces result wholly or partially in the lateral tilting of the cylinder receiving section away from the crankcase section, with an accompanying reduction in compression.

The engine compression is adjusted by means of adjusting device 76 as follows:

When adjusting to provide reduced compression valve B is opened first so that the internal forces in the engine (i.e. the compressive forces in the engine cylinders resulting from the compression and combustion) are allowed to tilt cylinder receiving section 2 away from crankcase section 4. In this case lever 74 is swung upwards (anticlockwise, as shown in FIG. 4), causing cylinder housing 80 to be pulled upwards so that piston 82 compresses the hydraulic fluid in chamber 92. The increasing pressure of the hydraulic fluid in chamber 92 is then transmitted via pipe 98, non-return valve 104 and valve B to pressure accumulator 96, which is consequently charged and forms a potential source of force which can later be used for a future adjustment and repositioning of lever 74 in the opposite direction.

When adjusting to provide increased compression valve C is opened first (valve B is then closed), so that the hydraulic pressure previously stored in pressure accumulator 96 can be transmitted via pipe 98, valve C and non-return valve 102 to chamber 92, whereby piston-cylinder arrangement 78 is compressed and lever 74 is swung in the downward direction (clockwise in FIG. 4). This has the effect of rotating bearing sections 72, 72' in bearing brackets 58 so that the eccentrically positioned shaft 56 moves downwards in an arc (towards the limit position shown in FIG. 4), causing cylinder receiving section 2 to be tilted downwards towards crankcase 4. When valves B and C am opened, valve A is also opened synchronously to prevent pressure counteracting the adjustment from being generated in chamber 94.

The adjustment of valves A, B and C is controlled by a control unit 112, which adjusts the engine compression ratio so that it is optimum in relation to the operating conditions of the engine. At least load and speed transmitters are used to detect the operating conditions of the engine, and an angular position transmitter, arranged for example on either of shafts 20, 56, or a transmitter on cylinder housing 80, is used for the compression feedback.

FIG. 4 shows diagrammatically how control unit 112 receives input signals from a load transmitter 114, a speed transmitter 116 and an angular position transmitter 118. The signals are transmitted to the control unit via signal cables 120, 122 and 124 respectively.

Valves A, B and C are controlled by means of their associated electromagnets, whose activation (for opening/closing the valves) is controlled by control unit 112, which is provided for this purpose with control outputs from which output signals are transmitted to the electromagnets via signal cables 126, 128 and 130 respectively.

We claim:

1. A method of varying the compression of an internal combustion engine having a cylinder receiving section pivotably mounted to a crankcase section, which method comprises:

providing tilting means for tilting the cylinder receiving section relative to the crankcase section to adjust the distance between the cylinder receiving section and the crankcase section to vary the compression of the engine, the tilting means including an adjusting mechanism comprising a hydraulic piston-cylinder arrangement wherein the piston divides the cylinder into first and second variable chambers;

adjusting the position of the piston in the cylinder to adjust the distance between the cylinder section and the crankcase section;

hydraulically connecting the first chamber to a pressure accumulator;

hydraulically connecting the second chamber to a reservoir of the hydraulic fluid for refilling or evacuating the second chamber;

storing hydraulic pressure from the first chamber in the pressure accumulator when the cylinder receiving section tilts relative to the crank case section in a first direction to vary the compression of the engine in a first direction; and transmitting hydraulic pressure from the pressure accumulator to the first chamber to tilt the cylinder receiving section relative to the crank case section in an opposite direction to vary the compression of the engine in an opposite direction.

2. A method according to claim 1, wherein the tilting means includes a rotary mechanism which rotates relative to the crankcase section to a variable angular position, the angular position of the rotary mechanism being a function of the distance between the cylinder receiver section and the crankcase section, and the method further comprises coupling the rotary mechanism to the piston-cylinder arrangement to vary the position of the piston in the cylinder in accordance with the angular position of the mechanism.

3. A method according to claim 2, wherein the coupling of the rotary mechanism to the piston-cylinder arrangement is effected by rigidly mounting one end of a lever to the rotary mechanism and hingedly connecting another end of the lever to the cylinder of the piston-cylinder arrangement.

4. A method according to claim 3, wherein an end of the piston projects from the cylinder and the method further comprises pivotally connecting said end to a support fixed relative to the crankcase section.

5. A method according to claim 2, wherein compression and combustion in engine cylinders located in the cylinder receiving section generate separating forces between the cylinder receiving section and the crankcase section, such separating forces causing rotation of the rotary mechanism and adjustment of the position of the piston in the cylinder, the adjustment of the position of the piston causing a hydraulic pressure to be generated in the first chamber.

6. A method according to claim 5, in which the step transmitting hydraulic pressure from the pressure accumulator to the first chamber changes the position of the piston in the cylinder such as to rotate the rotary mechanism in a direction to move the cylinder receiving section towards the crankcase section to thereby increase the compression of the engine.

7. A compression adjusting device for an internal combustion engine having a cylinder receiving section pivotally mounted on a crankcase section of the engine, which device comprises:

tilting means for moving the crankcase section relative to the cylinder receiving section to vary the compression of the engine, the tilting means including a hydraulic piston-cylinder arrangement connected between the crankcase section and the cylinder receiving section, the hydraulic piston-cylinder arrangement including a piston moveable within the cylinder, the piston dividing the cylinder into first and second chambers;

a reservoir for receiving hydraulic fluid;

a pressure accumulator;

means for hydraulically connecting the first chamber to the pressure accumulator to store hydraulic pressure from the first chamber when the cylinder receiving section tilts relative to the crankcase section in a first direction to vary the compression of the engine in a first direction and to transmit hydraulic pressure from the accumulator to the first chamber to tilt the cylinder receiving section relative to the crankcase section in an opposite direction to vary the compression of the engine in the opposite direction; and means for hydraulically connecting the second chamber to the reservoir.

8. A compression adjusting device according to claim 7, in which the cylinder receiving section of the engine supports a cylinder head and is provided with bearing lugs, and wherein the tilting means comprises an upper bearing shaft mounted in the bearing lugs, a lower eccentric shaft rotatably mounted in the crankcase section, connecting elements connected between the upper bearing shaft and the lower eccentric shaft, and at least one lever having one end rigidly connected to the eccentric shaft and the other end connected to the cylinder of the piston-cylinder of the piston cylinder arrangement.

9. A compression adjusting device according to claim 8, wherein an end of the piston projects from the cylinder, the end being pivotally connected to a support fixed relative to the crankcase section.

10. A compression adjusting device as in claim 9, wherein the means for hydraulically connecting the second chamber to the pressure accumulator includes non-return valve means.

11. A compression adjusting device according to claim 10, wherein the non-return valve means comprises a pair of electrically controlled shutoff valves connected together in parallel and connected to the first chamber by non-return valves opening in opposite directions.

12. A compression adjusting device according to claim 11, wherein the means for connecting the second chamber to the hydraulic fluid reservoir includes an electrically controlled shutoff valve, opened synchronously with the opening of one of the pair of shutoff valves in the non-return valve means.

* * * * *